US009773629B1

(12) United States Patent
Wu et al.

(10) Patent No.: US 9,773,629 B1
(45) Date of Patent: Sep. 26, 2017

(54) MAGNETIC SENSING SWITCH

(71) Applicant: FINETEK Co., Ltd., New Taipei (TW)

(72) Inventors: Ting-Kuo Wu, New Taipei (TW); Chih-Wen Wang, New Taipei (TW); Cheng-Tao Li, New Taipei (TW)

(73) Assignee: FINETEK CO., LTD., New Taipei (TW)

( * ) Notice: Subject to any disclaimer, the term of this patent is extended or adjusted under 35 U.S.C. 154(b) by 0 days.

(21) Appl. No.: 15/346,917

(22) Filed: Nov. 9, 2016

(51) Int. Cl.
*H01H 36/00* (2006.01)
*H01H 50/02* (2006.01)
*H01H 36/02* (2006.01)

(52) U.S. Cl.
CPC ..... *H01H 50/023* (2013.01); *H01H 36/0013* (2013.01); *H01H 36/0033* (2013.01); *H01H 36/02* (2013.01); *H01H 2223/002* (2013.01)

(58) Field of Classification Search
CPC ..... H01H 36/00–36/02
USPC ..... 335/205–207, 151–154; 200/84 C
See application file for complete search history.

(56) References Cited

U.S. PATENT DOCUMENTS 3,874,223 A * 4/1975 Miyazaki ..... G01F 23/223 200/84 C
4,278,858 A * 7/1981 Kaessen ..... H01H 36/02 200/84 B
4,513,184 A * 4/1985 Hughes ..... H01H 35/405 200/81.9 M
6,254,432 B1 * 7/2001 Yoshigi ..... H01R 13/5208 439/604

* cited by examiner

*Primary Examiner* — Ramon M Barrera
(74) *Attorney, Agent, or Firm* — Chun-Ming Shih; HDLS IPR Services

(57) ABSTRACT

A magnetic sensing switch includes switch body having a hollow tube and an opening. A magnetic reed switch is disposed in the tube and includes two conductive points. The plug having an elastic clamping force is fixed in the opening by interference fit. The plug including a sealant injection portion and a retaining portion communicating with the tube. The two wires are inserted in the tube, one end of each wire is connected to one conductive point, and the other end passes through the retaining portion to protrude out of the tube. A sealant is injected into the tube via the sealant injection portion to entirely wrap the magnetic reed switch and the wires inside the tube, and the sealant partially protrudes out of the sealant injection portion.

10 Claims, 8 Drawing Sheets

MAGNETIC SENSING SWITCH

TECHNICAL FIELD

The present invention relates to a magnetic sensing switch and, in particular, to a magnetic sensing switch which can improve a production yield, enhance production efficiency, and reduce production costs.

BACKGROUND

Generally speaking, a magnetic sensing switch or a float switch is a liquid level switch utilizing magnetic sensing. In a conventional magnetic sensing switch, a magnetic reed switch is disposed inside a hollow tube. When the magnetic reed switch is attracted by a movable magnet outside, the magnetic reed switch moves, and an electronic signal is thereby sent out to a controller to facilitate signaling or subsequent steps of the controller.

In manufacturing the conventional magnetic sensing switch, normally a sealant is injected into the hollow tube so as to position the magnetic reed switch inside the tube. However, since the space inside the hollow tube is small, outside air will certainly be brought into the inside of the hollow tube when the sealant is injected. The air inside the tube affects accurate positioning of the magnetic reed switch and the wires connected thereto, resulting in difficulties in securing the magnetic reed switch and the wires.

Furthermore, after a while, the air inside the hollow tube will become bubbles floating slowly upward to form recesses on a surface of the hollow tube, but a copper wire of the magnetic reed switch is thereby exposed, leading to insulation failure in the magnetic reed switch. This problem is typically remedied by piercing the bubbles after they float up, and then injecting the sealant again to fill the recesses on the surface of the hollow tube. Nevertheless, production is interrupted since curing of the sealant takes a longer period of time, production efficiency is thereby compromised, and production costs are increased. Moreover, when the bubble are floating up, the magnetic reed switch moves and changes its original predetermined position, thus decreasing a production yield of the magnetic sensing switch.

Accordingly, it is the aim of the present invention to solve the above-mentioned problems, on the basis of which the present invention is accomplished.

SUMMARY

It is an object of the present invention to provide a magnetic sensing switch. A plug of the magnetic sensing switch has at least one retaining portion and at least one sealant injection portion. Wires are fixed by the retaining portion, and a sealant is injected into a tube of a hollow shape via the sealant injection portion so as to wrap a magnetic reed switch and the related wires. Air at a space between the wires and the retaining portion is expelled via the air outlet, and the plug is interference fit in the hollow tube, thereby preventing a relative displacement between the magnetic reed switch and the wire.

Accordingly, the present invention provides a magnetic sensing switch, comprising a switch body, a magnetic reed switch, a plug, two wires, and a sealant. The switch body includes a tube of a hollow shape and an opening. The magnetic reed switch is disposed in the tube and includes two conductive points. The plug is made of an elastic material to provide an elastic clamping force. The plug is fixed in the opening by interference fit. The plug includes at least one sealant injection portion and at least one retaining portion communicating with the inside of the tube. The two wires are inserted in the tube. One end of each of the two wires is connected to a respective corresponding one of the two conductive points, and the other end of each of the two wires passes through the retaining portion to protrude out of the tube. The sealant is injected into the tube via the sealant injection portion, the sealant entirely wraps the magnetic reed switch and the wires inside the tube, and the sealant partially protrudes out of the sealant injection portion.

Compared with conventional techniques, the magnetic sensing switch includes the plug which is made of an elastic material like plastic or rubber to be compressible and to provide the elastic clamping force. The plug is fixed in the opening by interference fit and includes the sealant injection portion and the retaining portion communicating with the inside of the tube. According, by injecting the sealant into the tube, no air is left inside the tube. Moreover, the sealant can entirely wrap the magnetic reed switch and the wires inside the tube. Therefore, after the sealant is cured, the magnetic reed switch is immovable, thereby achieving accurate positioning of components of the magnetic sensing switch, improving production efficiency and a production yield for the magnetic sensing switch, and enhancing convenience and practicability.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
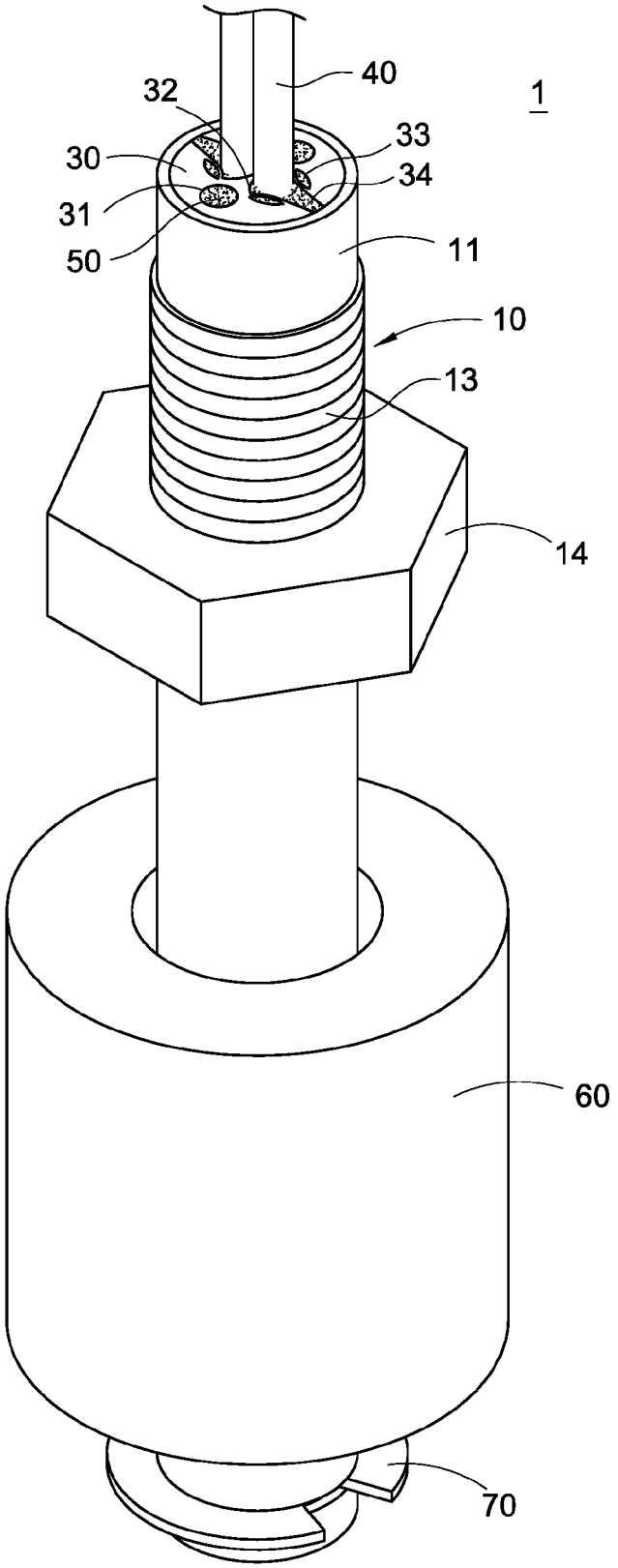
FIG. 1 is a perspective view illustrating a magnetic sensing switch according to the present invention.
Figure 2:
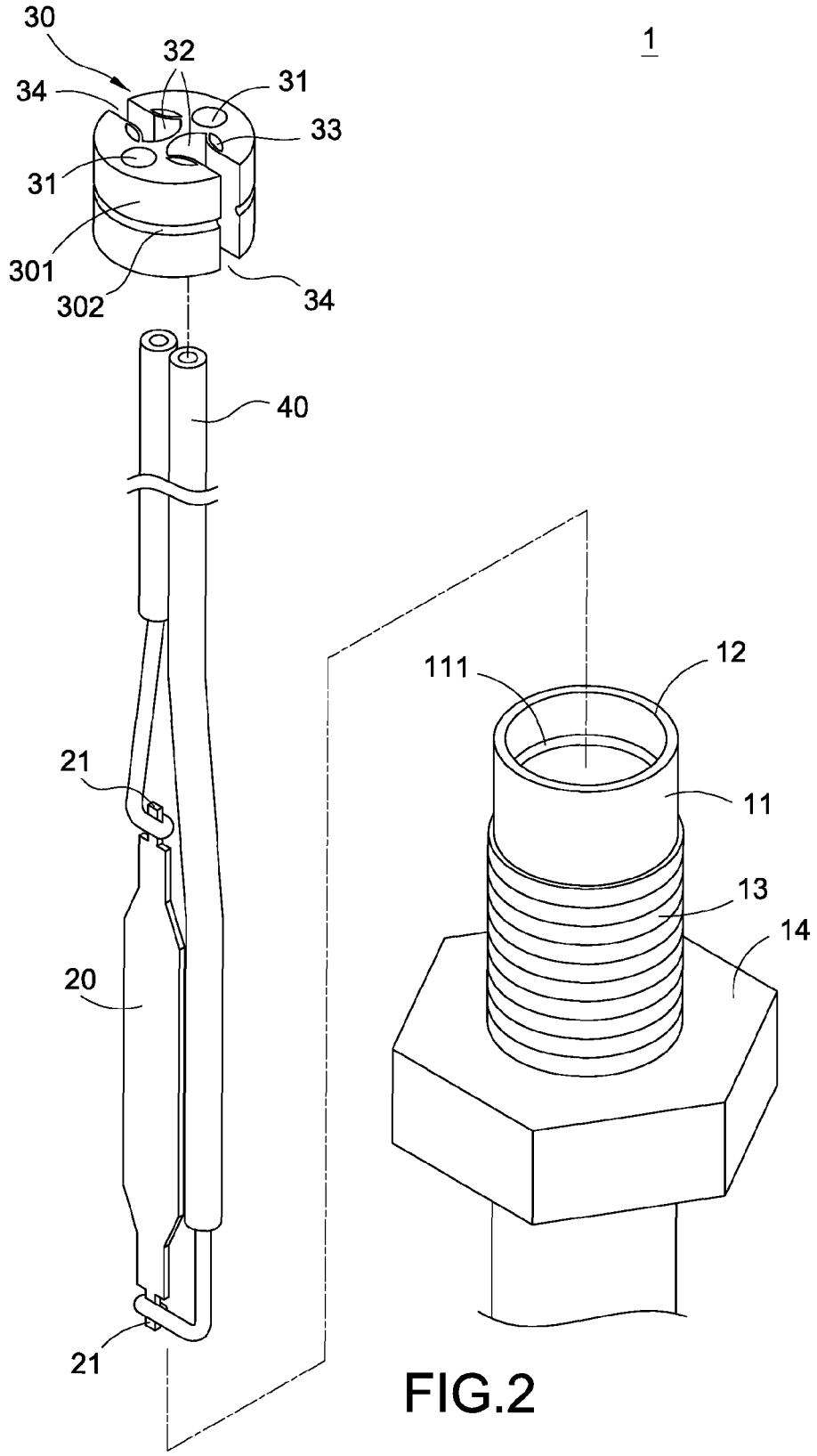
FIG. 2 is a perspective exploded view illustrating the magnetic sensing switch.

Please refer to FIGS. 1 and 2, showing a perspective view and a perspective exploded view of a magnetic sensing switch according to the present invention. The present invention is a magnetic sensing switch 1, comprising a switch body 10, a magnetic reed switch 20, a plug 30, two wires 40, and a sealant 50. The magnetic reed switch 20 and the two wires 40 are disposed inside the switch body 10. The plug 30 closes the switch body 10, and the sealant 50 is injected into the switch body 10 for fixing the magnetic reed switch 20 and the two wires 40 inside the switch body 10. A detailed description of the magnetic sensing switch 1 is provided hereinafter.

The switch body 10 includes a tube 11 of a hollow shape and an opening 12. According to one embodiment of the present invention, the switch body 10 further includes a threaded portion 13 and a base 14. The threaded portion 13 is adapted for fastening the switch body 10 to a fixed object (not illustrated) like a container. The base 14 is adapted to be operated by a hand tool (not illustrated) so as to rotate the switch body. The switch body 10 is fastened to the fixed object having a threaded hole by means of the threaded portion 13.

The magnetic reed switch 20 is disposed in the tube 11, and the magnetic reed switch 20 includes two conductive points 21. The structure of the magnetic reed switch 20 is a conventional technique, so a detailed description thereof is omitted for brevity.

The plug 30 is made of an elastic material like plastic or rubber to be compressible and to provide an elastic clamping force. Furthermore, the plug 30 is fixed in the opening 12 of the switch body 10 by interference fit. The plug 30 includes at least one sealant injection portion 31 and at least one retaining portion 32 communicating with the inside of the tube 11 of the switch body 10. The sealant injection portion 31 is a circular hole, and the retaining portion 32 is an arc-shaped hole. The plug 30 has a thickness complying with electrical safety standards. It is preferable that the plug 30 has a thickness of more than 3 millimeters and is capable of clamping the two wires 40.

The two wires 40 are inserted in the tube 11. One end of each of the two wires 40 is connected to a respective corresponding one of the two conductive points. The other end of each of the two wires 40 passes through the retaining portion 32 of the plug 30 to protrude out of the tube 11.

After the magnetic reed switch 20 and the two wires 40 are disposed inside the tube 11, the plug 30 is inserted and fixed in the opening 12 of the switch body 10, and then the sealant 50 is injected into the inside of the tube 11.

The sealant 50 is an insulating sealant like epoxy resin. The sealant 50 is injected into the tube 11 via the sealant injection portion 31 of the plug 30. The sealant 50 entirely wraps the magnetic reed switch 20 and the wires 40 inside the tube 11, and the sealant 50 partially protrudes out of the sealant injection portion 31.

According to one embodiment of the present invention, the magnetic sensing switch 1 further includes a float 60 receiving the tube 11 of the switch body 10 and includes a block plate 70 disposed outside the tube 11. The float 60 is blocked by the blocked plate 70 to prevent the float 60 from moving beyond the tube 11. The block plate 70 can be a C-shaped fastening element, for example. In practice, a magnetic element (not illustrated) is disposed inside the float 60. The float 60 is movable outside the tube 11 in response to liquid level changes. When the float 60 moves to a predetermined position, the magnetic reed switch 20 inside the tube 11 is attracted by the magnetic element to move, thereby sending out an electronic signal.

It should be noted that, in the present embodiment, an outer surface 301 of the plug 30 includes a first connection portion 302, and an inner surface of the tube 11 includes a second connection portion 111 corresponding to the first connection portion 302. The plug 30 is fixed in the opening 12 of the tube 11 by joining the first connection portion 302 with the second connection portion 111, thereby preventing the plug 30 from being excessively pressed into the tube 11, so as to retain the position of the plug 30 in the tube 11. In the preset embodiment, the first connection portion 302 is an annular groove, and the second connection portion 111 is an annular rib; however, in practice, the first connection portion 302 and the second connection portion 111 can be any structures fastened to each other, and the present invention is not limited in this regard.

Figure 3:
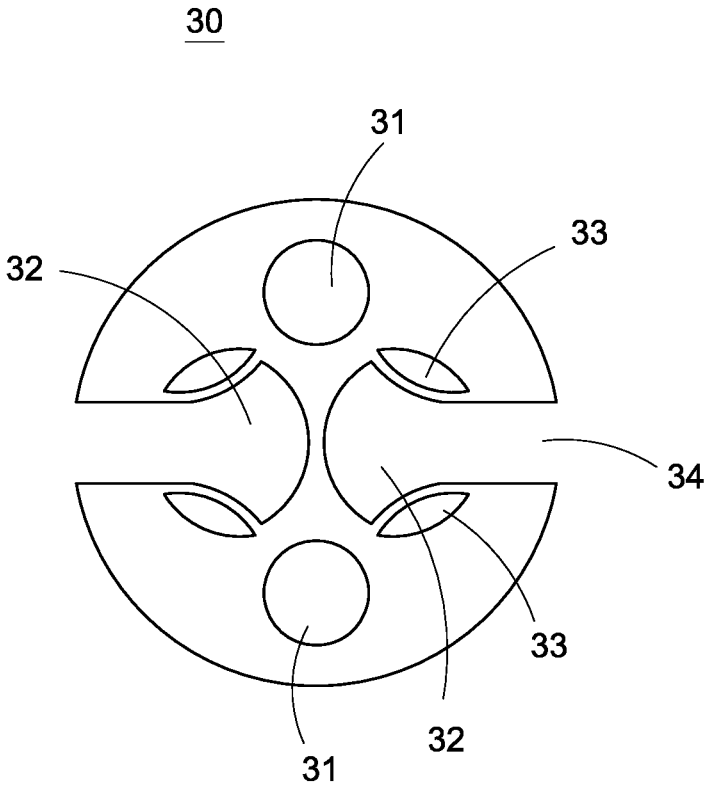
FIG. 3 is a top view illustrating a plug of the magnetic sensing switch.
Figure 4:
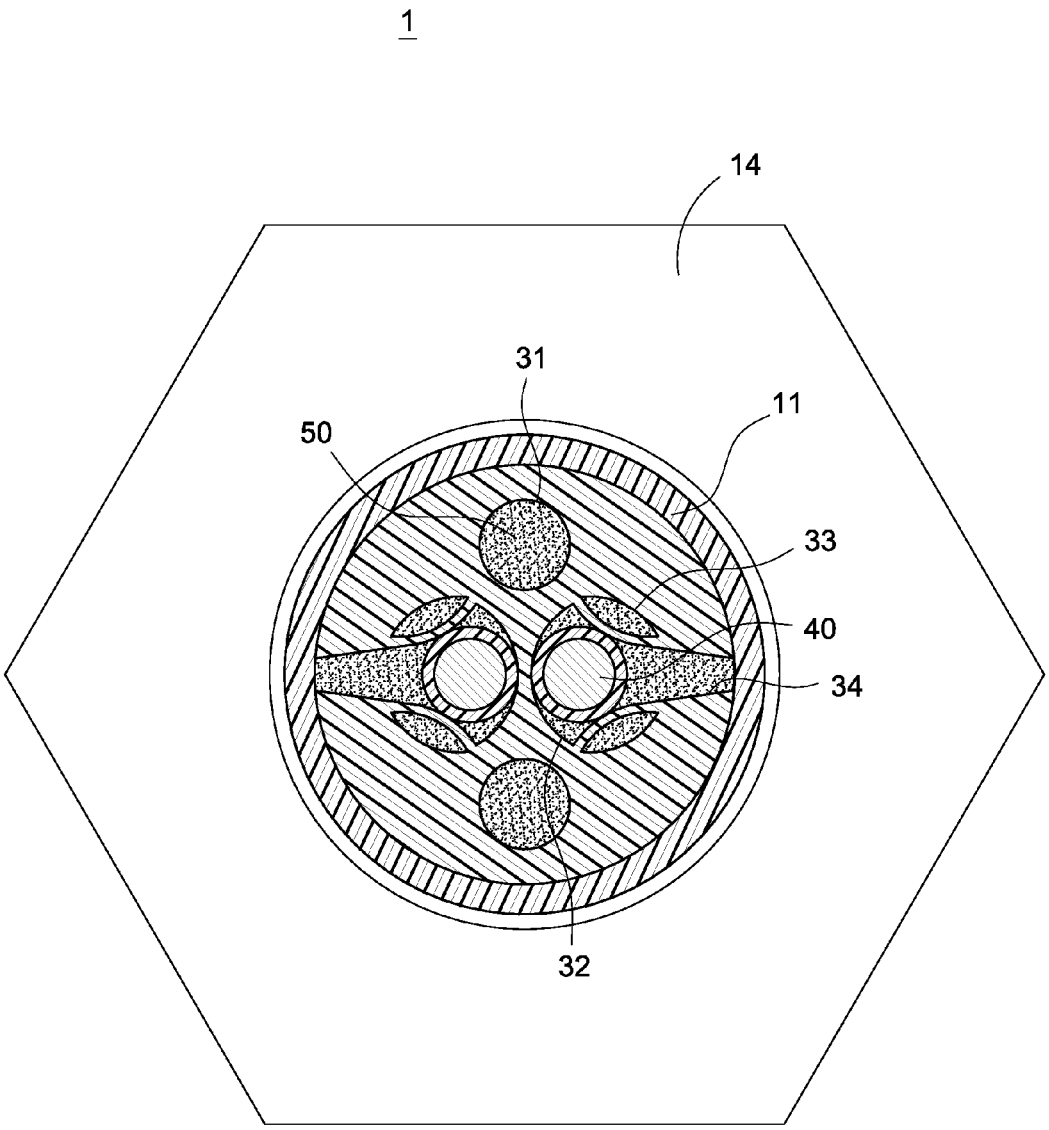
FIG. 4 is a cross-sectional view illustrating the magnetic sensing switch.

Please refer to FIGS. 3 and 4, showing a top view of the plug and a cross-sectional view of the magnetic sensing switch. As shown in FIG. 3, in the present embodiment, the plug 30 includes two sealant injection portions 31, two retaining portions 32 and a plurality of air outlets 33. Furthermore, the two sealant injection portions 31 are arranged symmetrically at two sides of the two retaining portions 32, and the air outlets 33 are arranged in pairs symmetrical to each other and at opposite sides of each retaining portion 32. Moreover, the plug 30 includes a breach 34 extending from the retaining portion 32 to a lateral edge of the plug 30, and each of the wires 40 is interference fit into the retraining portion 32 from the breach 34 and is elastically clamped and fixed by the retaining portion 32. The sealant 50 is injected into the tube 11 from the sealant injection portion 31.

Referring to FIG. 4, the two wires 40 are positioned in the two retaining portions 32, respectively. When the sealant 50 is injected into the tube 11 from the sealant injection portion 31, air inside the tube 11 is pushed by the sealant 50 to be discharged from the air outlets 33. After a certain amount of the sealant 50 is injected into the tube 11, the sealant 50 is partially exposed from the two sealant injection portions 31 and the air outlets 33. Accordingly, no air remains inside the tube 11, and the sealant 50 can entirely wrap the magnetic reed switch 20 and the wires 40 inside the tube 11. In addition, after the sealant 50 is cured, the magnetic reed switch 20 inside the tube 11 is immovable, thus achieving accurate positioning of components of the magnetic sensing switch 1, and improving production efficiency and a production yield of the magnetic sensing switch 1.

Figure 5:
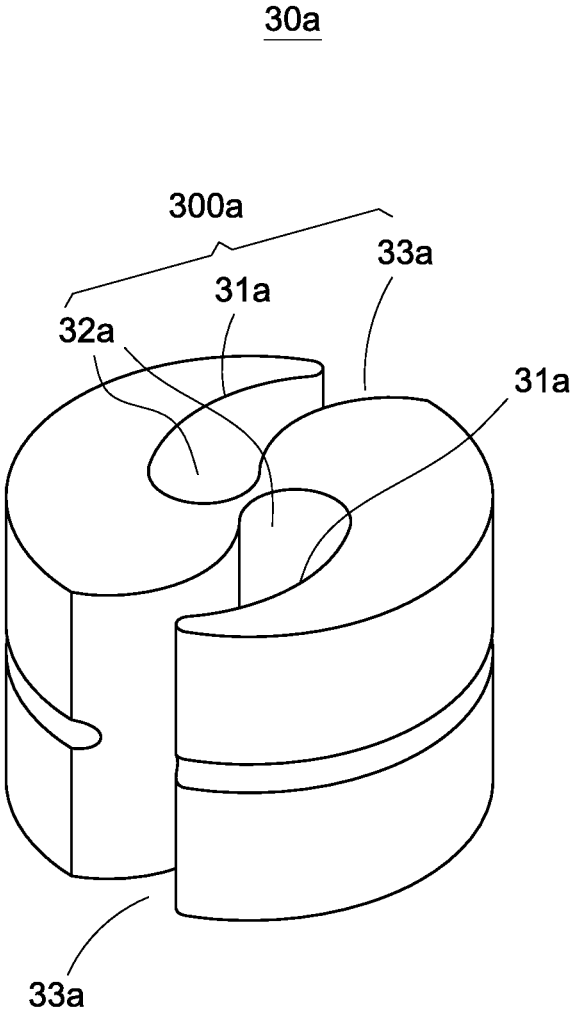
FIG. 5 is a perspective view illustrating the plug according to another embodiment of the present invention.
Figure 6:
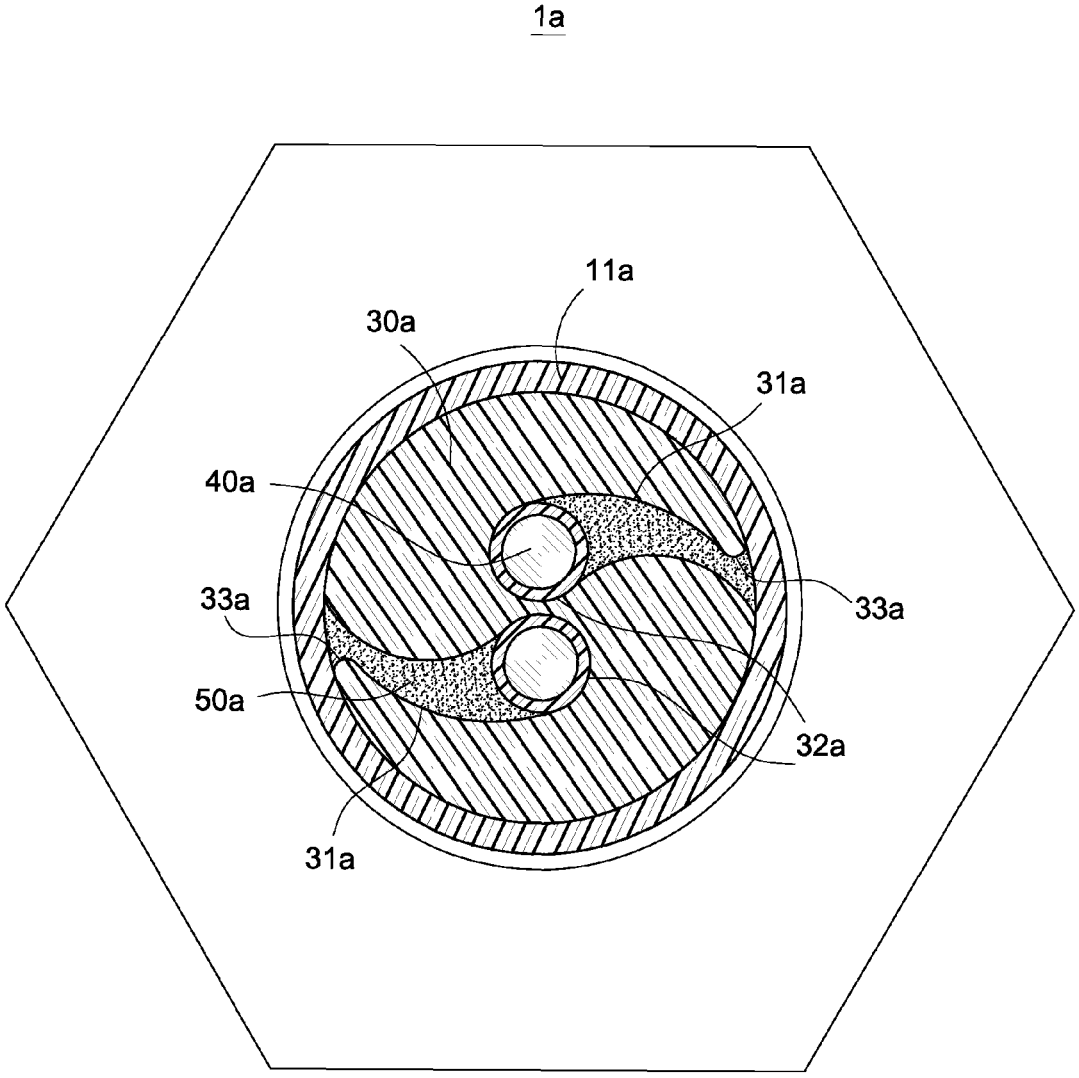
FIG. 6 is a cross-sectional view illustrating the magnetic sensing switch according to the another embodiment of the present invention.

Please refer to FIGS. 5 and 6, showing a perspective view of the plug and a cross-sectional view of the magnetic sensing switch, according to another embodiment of the present invention. The present embodiment is similar to the previous embodiment. The magnetic sensing switch **1*a* includes a switch body 10*a*, a magnetic reed switch (not illustrated), a plug 30*a*, two wires 40*a*, and a sealant 50*a*. The plug 30*a* forms at least one sealant injection portion 31*a* and at least one retaining portion 32*a*. The present embodiment is different from the previous embodiment in the structure of the plug 30*a***.

As shown in FIG. 5, in the present embodiment, the plug **30*a* forms two slots 300*a*. In detail, each of the slots 300*a* consists of the sealant injection portion 31*a* and the retaining portion 32*a*, and each of the slots 300*a* includes one sealant injection portion 31*a* and one retaining portion 32*a* communicating with this one sealant injection portion 31*a*. The retaining portion 32*a* is a circular hole, and the sealant injection portion 31*a* is an arc-shaped hole. It is preferable that the retaining portion 32*a* forms a gap 33*a* extending from the sealant injection portion 31*a* to a lateral edge of the plug 30*a*. Each wire 40*a* is interference fit into the retaining portion 32*a* from the gap 33*a* and is elastically clamped and fixed by the retaining portion 32*a***.

Referring to FIG. 6, the two wires **40*a* are positioned in the two retaining portions 32*a*, respectively. The sealant 50*a* is injected into the tube 11*a* from the sealant injection portion 31*a*. After a certain amount of the sealant 50*a* is injected into the tube 11***a*, the sealant 50*a* can entirely wrap the magnetic reed switch and the wires 40*a* inside the tube 11*a*.

Figure 7:
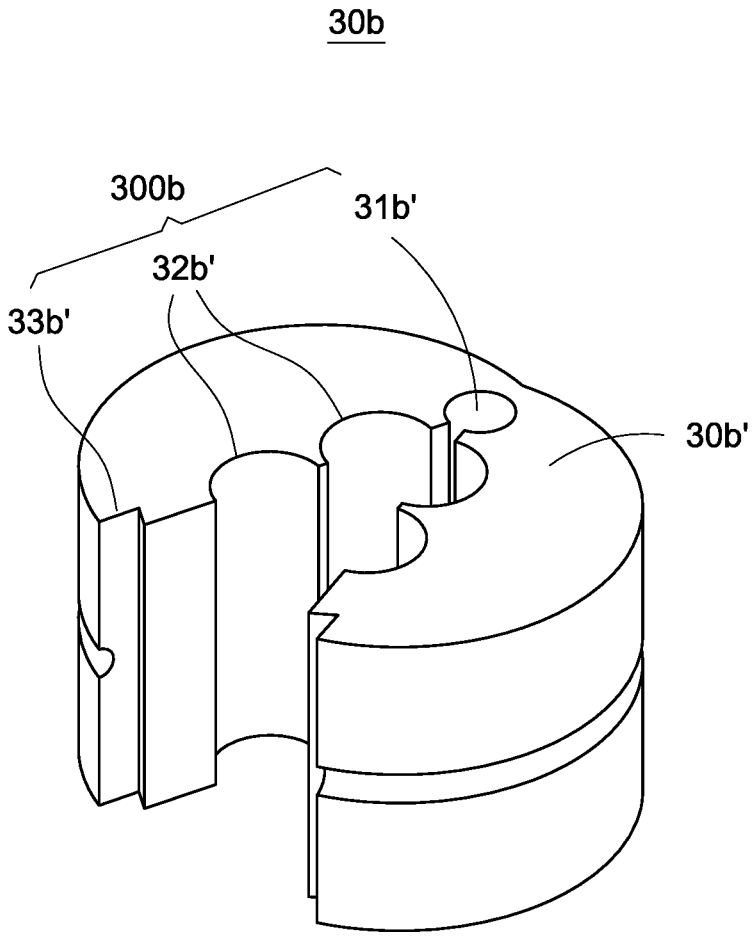
FIG. 7 is a perspective view illustrating the plug according to still another embodiment of the present invention.
Figure 8:
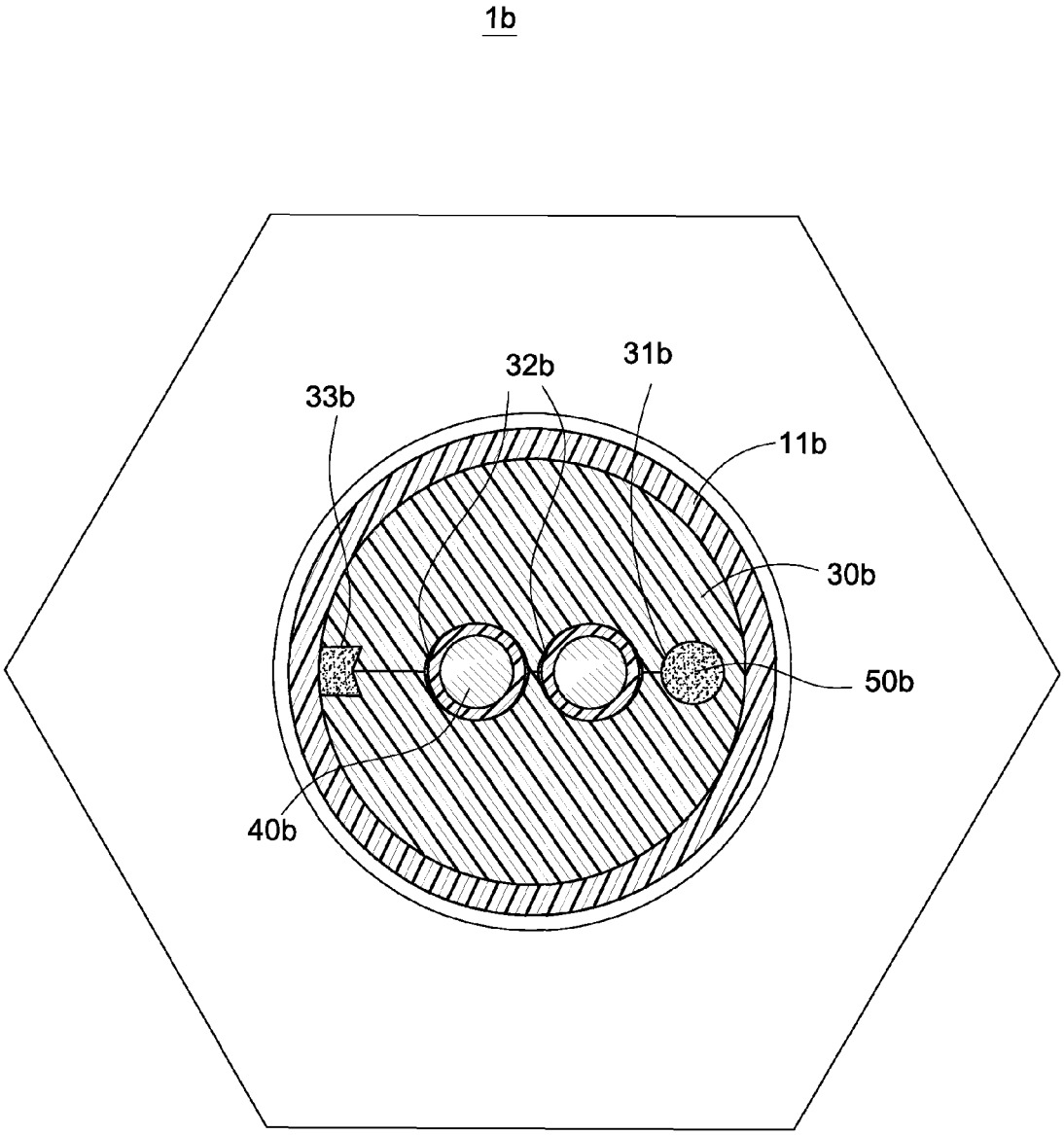
FIG. 8 is a cross-sectional view illustrating the magnetic sensing switch according to the still another embodiment of the present invention.

Please refer to FIG. 7 and FIG. 8, showing a perspective view of the plug and a cross-sectional view of the magnetic sensing switch, according to the still another embodiment of the present invention. The present embodiment is similar to the previous embodiment. The magnetic sensing switch 1*b* includes a switch body 10*b*, a magnetic reed switch (not illustrated), a plug 30*b*, two wires 40*b*, and a sealant 50*b*. The plug 30*b* forms at least one sealant injection portion 31*b* and at least one retaining portion 32*b*. The sealant injection portion 31*b* and the retaining portion 32*b* are each a circular hole. The present embodiment is different from the previous embodiment in the structure of the plug 30*b*.

As shown in FIG. 7, in the present embodiment, the plug 30*b* is constituted by two semi-circular columns 30*b*' to be openable and closable. A groove set 300*b* in a continuous wave shape is formed on one side of each semi-circular column 30*b*', and the two groove sets 300*b* of the plug 30*b* together form the sealant injection portion 31*b* and the retaining portion 32*b* after the two semi-circular columns 30*b*' are closed together.

To be specific, each of the groove sets 300*b* includes a sealant injection groove 31*b*', two retaining grooves 32*b*' and an engagement groove 33*b*'. The sealant injection groove 31*b*' and the retaining groove 32*b*' are each a semi-circular hole. The two groove sets 300*b* of the plug 30*b* together form a sealant injection portion 31*b*, two retaining portions 32*b*, and one engagement portion 33*b* spaced apart from each other after the two semi-circular columns 30*b*' are closed together. The two retaining portions 32*b* are disposed between the sealant injection portion 31*b* and the engagement portion 33*b*.

Referring to FIG. 8, the two wires 40*b* are positioned in the two retaining portions 32*b*, respectively. The sealant 50*b* is injected into the tube 11*b* from the sealant injection portion 31*b*. After a certain amount of the sealant 50*b* is injected into the tube 11*b*, the sealant 50*b* is partially exposed from the sealant injection portion 31*b* and the engagement portion 33*b*. The two semi-circular columns 30*b*' are joined by filling the sealant 50*b* into the engagement portion 33*b*. In addition, the sealant 50*b* can entirely wrap the magnetic reed switch and the wires 40*b* inside the tube 11*b*.

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. A magnetic sensing switch, comprising:

a switch body, the switch body including a tube of a hollow shape and an opening;

a magnetic reed switch, the magnetic reed switch being disposed in the tube and including two conductive points;

a plug made of an elastic material to provide an elastic clamping force, the plug being fixed in the opening by interference fit, the plug including at least one sealant injection portion and at least one retaining portion communicating with the inside of the tube;

two wires inserted in the tube, one end of each of the two wires being connected to a respective corresponding one of the two conductive points, the other end of each of the two wires passing through the retaining portion to protrude out of the tube; and a sealant, the sealant being injected into the tube via the sealant injection portion, the sealant entirely wrapping the magnetic reed switch and the wires inside the tube, the sealant partially protruding out of the sealant injection portion.

2. The magnetic sensing switch of claim 1, wherein the plug has a thickness complying with electrical safety standards.

3. The magnetic sensing switch of claim 1, wherein the plug has two sealant injection portions, two retaining portions and a plurality of air outlets, the two sealant injection portions are arranged symmetrically at two sides of the two retaining portions, and the air outlets are arranged in pairs symmetrical to each other and at opposite sides of each retaining portion.

4. The magnetic sensing switch of claim 3, wherein the plug includes a breach extending from the retaining portion to a lateral edge of the plug, and each of the wires is interference fit into the retraining portion from the breach and is elastically clamped and fixed by the retaining portion.

5. The magnetic sensing switch of claim 3, wherein the plug forms two slots spaced apart from each other, the slot consists of the sealant injection portion and the retaining portion, and each of the slots includes one sealant injection portion and one retaining portion communicating with this one sealant injection portion.

6. The magnetic sensing switch of claim 5, wherein the retaining portion forms a gap extending from the sealant injection portion to a lateral edge of the plug, and each wire is interference fit into the retaining portion from the gap and is elastically clamped and fixed by the retaining portion.

7. The magnetic sensing switch of claim 1, wherein the plug is constituted by two semi-circular columns to be openable and closable, a groove set in a continuous wave shape is formed on one side of each semi-circular column, and the two groove sets of the plug together form the sealant injection portion and the retaining portion after the two semi-circular columns are closed together.

8. The magnetic sensing switch of claim 7, wherein each of the groove sets includes a sealant injection groove, two retaining grooves and an engagement groove, the two groove sets of the plug form a sealant injection portion, two retaining portions, and an engagement portion spaced apart from each other after the two semi-circular columns are closed together, and the two retaining portions are disposed between the sealant injection portion and the engagement portion.

9. The magnetic sensing switch of claim 1, wherein an outer surface of the plug includes a first connection portion, an inner surface of the tube includes a second connection portion corresponding to the first connection portion, and the plug is fixed in the tube by joining the first connection portion with the second connection portion.

10. The magnetic sensing switch of claim 1, further comprising a float receiving the tube and comprising a block plate disposed outside the tube, the float being blocked by the block plate to prevent the float from moving beyond the tube.

* * * * *